US006276979B1

(12) United States Patent
Saltel et al.

(10) Patent No.: US 6,276,979 B1
(45) Date of Patent: Aug. 21, 2001

(54) FLOATING WATER CHAIR

(76) Inventors: Ronald L. Saltel, 99 Edgewater Drive, Winnipeg, Manitoba (CA), R2J 2V4; Daniel L. Saltel, 47 Garwick Cove, Winnipeg, Manitoba (CA), R2J 4C2; Cameron J. Saltel, 168 High Ridge Road, Winnipeg, Manitoba (CA), R3X 1H5

( * ) Notice: Subject to any disclaimer, the term of this patent is extended or adjusted under 35 U.S.C. 154(b) by 0 days.

(21) Appl. No.: 09/443,771

(22) Filed: Nov. 19, 1999

Related U.S. Application Data

(60) Provisional application No. 60/109,173, filed on Nov. 20, 1998.

(51) Int. Cl.[7] ..... B63C 9/08; B63B 35/78

(52) U.S. Cl. ..... 441/132

(58) Field of Search ..... 441/129–132; 472/129

(56) References Cited

U.S. PATENT DOCUMENTS 1,960,474 * 5/1934 Browne ..... 441/129
5,520,561 * 5/1996 Langenohl ..... 441/132
5,562,514 * 10/1996 Rowe ..... 441/130
5,571,036 11/1996 Hannigan ..... 441/129
5,628,658 5/1997 Clifford ..... 441/130
5,885,123 3/1999 Clifford ..... 441/129

* cited by examiner

*Primary Examiner*—Sherman Basinger
(74) *Attorney, Agent, or Firm*—Curtis V. Harr

(57) ABSTRACT

A floating chair is provided which is made up of a U-shaped mesh seat which has, along the outer edge of the hemispherical portion of the U-shape, a sewn tube which is of the correct inside diameter to allow a commonly used cylindrical closed cell foam water toy to be passed trough it. The water toy provides floatation to the mesh seat, which in turn allows a swimmer to place it on the surface of a body of water (such as a swimming pool or lake) and then place himself on the mesh seat, having his back resting on the closed portion of the U. This configuration allows the swimmer to float on the surface of the water without expending any energy to stay afloat and, thus, enhances a swimmer's enjoyment of water recreation.

11 Claims, 7 Drawing Sheets

FIG 1
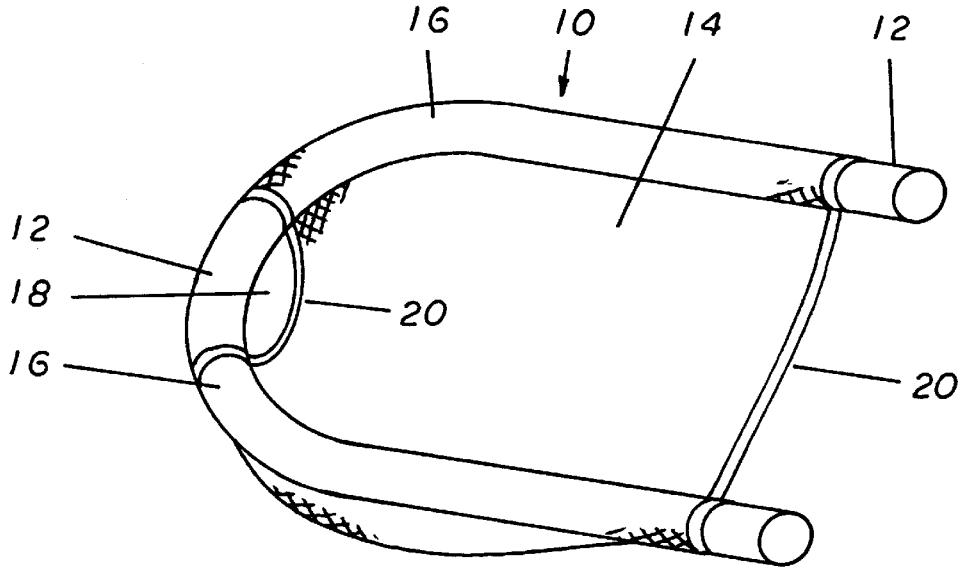
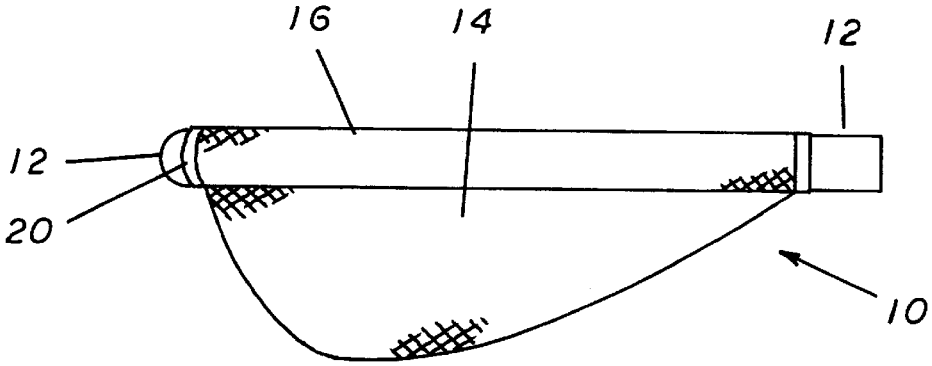
FIG 2

FIG 3
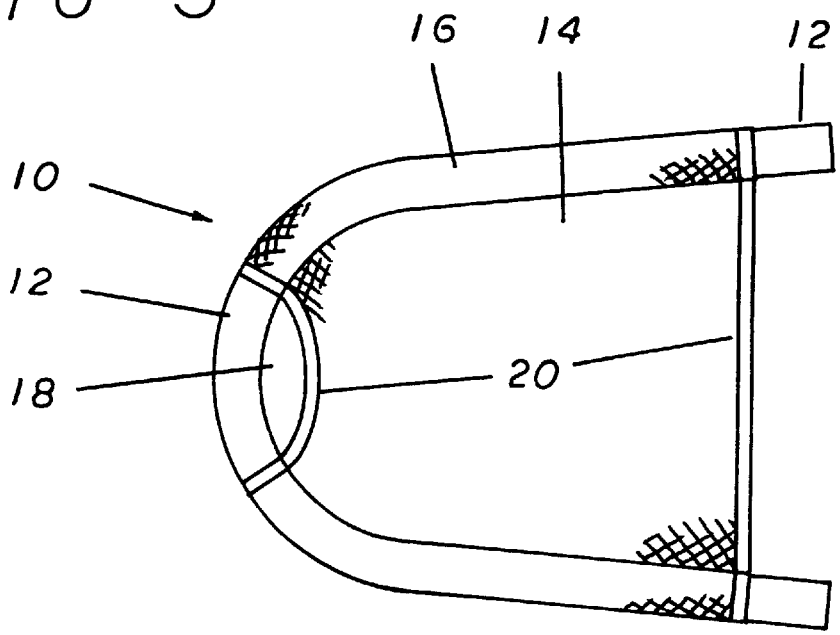
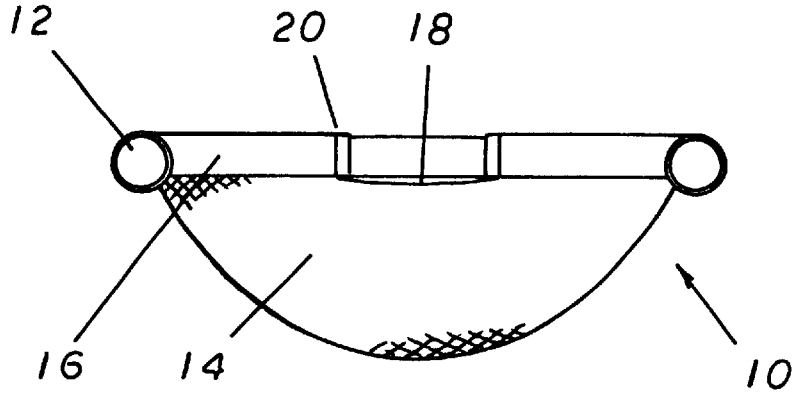
FIG 4

FIG 5
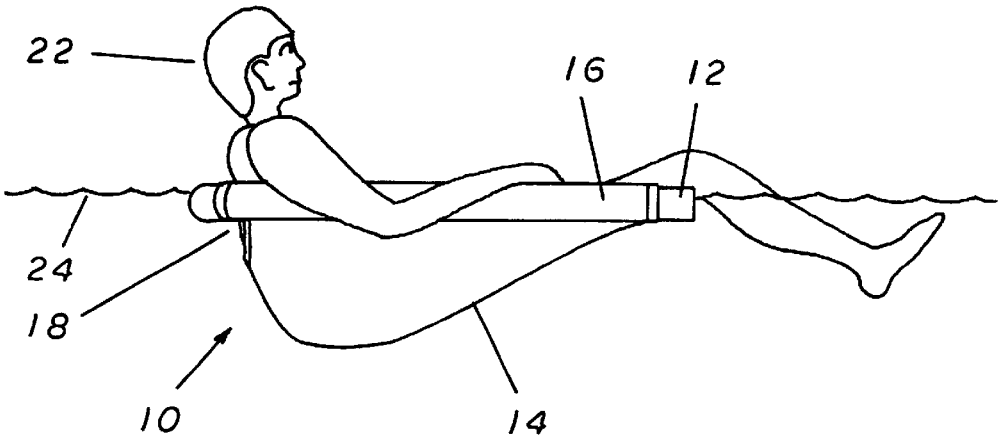
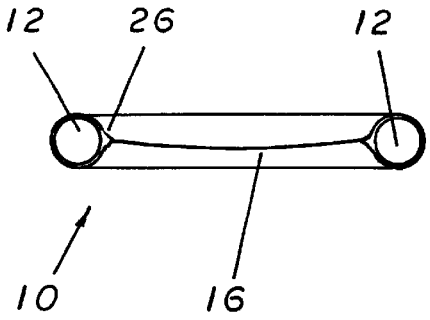
FIG 6
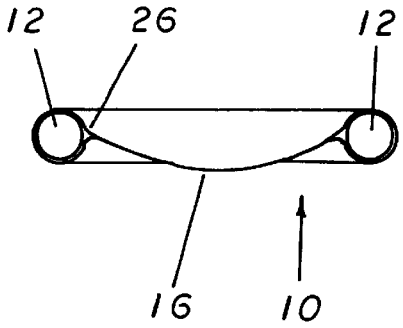
FIG 7

FIG 8
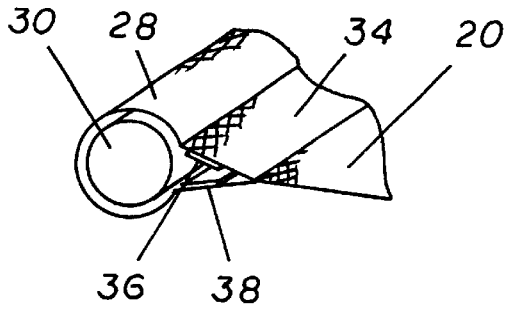
FIG 9
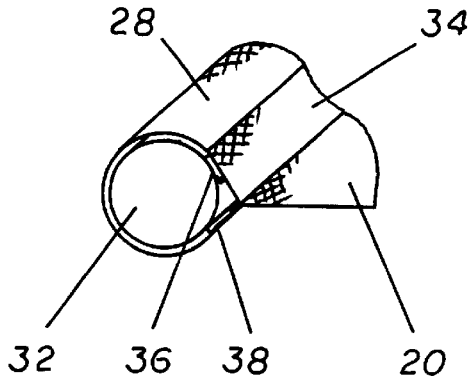
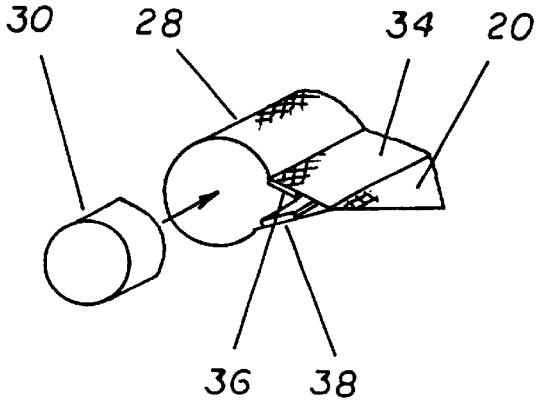
FIG 10
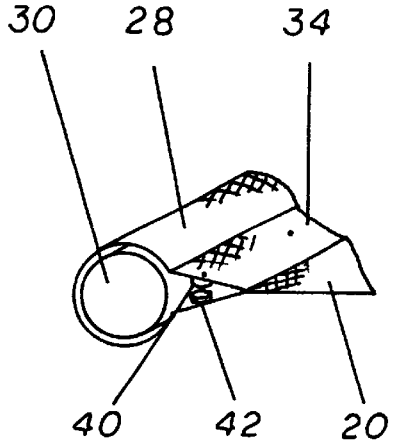
FIG 11

FIG 16
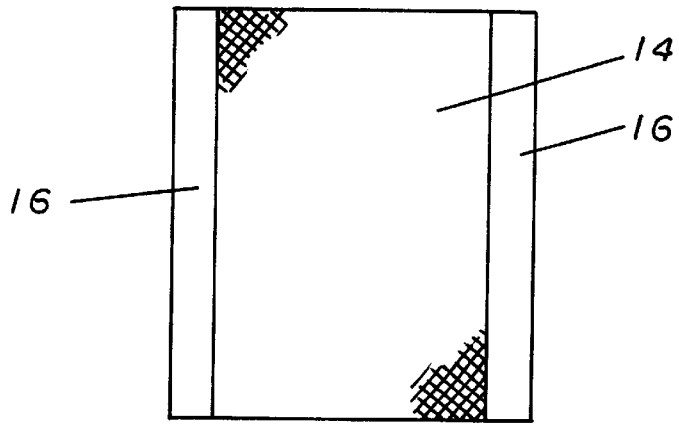
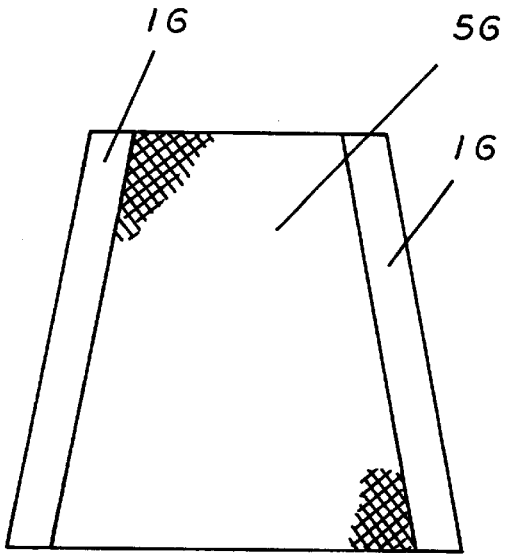
FIG 17
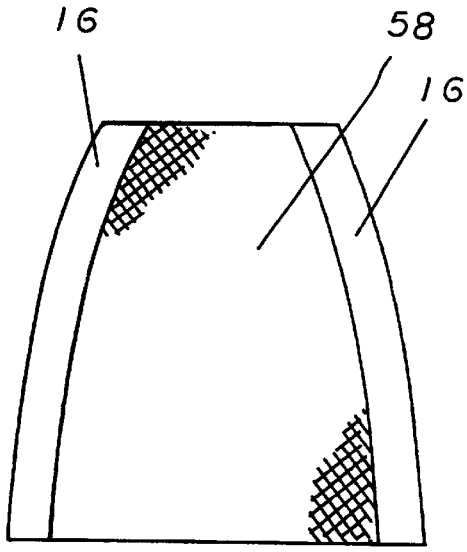
FIG 18

FLOATING WATER CHAIR

This application claims the benefit of U.S. Provisional Application No. 60/109,173 filed Nov. 20, 1998.

BACKGROUND OF THE INVENTION

The present invention relates to an improvement in water toys and more particularly to a floating chair.

Pool and water toys have long been popular with both young and old alike. One water toy to recently be used is a long closed cell foam, such as ETHAFOAM, tube or noodle. This toy is puncture resistant and can be used as floating toy, and thus has very popular. The tube or noodle has also been used in conjunction with other parts such as mesh or cloth pieces to form inexpensive water loungers, rafts and chairs. These chairs in the past have been constructed of several pieces of material and have thus been unnecessarily expensive and difficult to manufacture. From this discussion it can be seen that it would be desirable to create a chair that can utilize the tube or noodle for floatation and to make this chair in an inexpensive manor so as minimize the cost to the end user. Further it would be advantageous to make this chair as versatile as possible so as to maximize the end user's enjoyment of the water toy.

SUMMARY OF THE INVENTION

It is the primary objective of the present invention to provide a method by which a swimmer can relax in a chair at the surface of the water while allowing their bodies to be mostly submerged in the water.

It is an additional objective of the present invention to provide such a method that will employ the use of commonly used cylindrical water floatation devices made of closed cell foam and marketed under the trademark WATER NOODLE.

It is still a further objective of the present invention to provide a device that suspends a durable mesh seat between two arms of the cylindrical floatation device which will support a swimmer's body.

It is still a further objective of the present invention to provide such a device that is inexpensive to manufacture and purchase and that can be operated safely by swimmers of varying degrees of ability.

These objectives are accomplished by the use of a U-shaped mesh seat which has, along the outer edge of the hemispherical portion of the U-shape, a sewn tube which is of the correct inside diameter to allow a commonly used cylindrical closed foam water toy to be inserted into it. The water toy provides floatation to the mesh seat which allows a swimmer to place it on the surface of a body of water (such as a swimming pool or lake) and then place himself on the mesh seat, having his back resting on the closed portion of the U. This configuration allows the swimmer to float on the surface of the water without expending any energy to stay afloat and, thus, enhances a swimmer's enjoyment of water recreation.

The present invention uses a variety of means to secure the cylindrical floatation device (herein after "float") within the mesh of the chair. The standard method to accomplish this is to construct the floatation device tube so that its inside diameter is just large enough to allow the float to be threaded through it. In this method the friction between the float tube and the float itself is sufficient to hold the float in place within the mesh seat.

The second method of securing the float within the mesh seat is to place an elastic cord on the leading edge of the seat (that portion which spans the terminal ends of the U) and which encircles the terminal ends of the floatation securement tubes. In this configuration, as downward pressure is placed on the portion of the elastic cord that spans the U, it closes the portion surrounding the float which in turn holds the float within the floatation tube.

Finally, the third method uses a float tube that can be opened to allow for the insertion of the float and then closed and held in place by the use of Velcro, snaps, cord with a slip knot or other securement device. This design allows for the use of floats of varying outside dimensions with a single embodiment of the present invention.

The general design of the present invention also allows a user to join two floating chairs together to form one large chair. This is accomplished by the use of a joining sleeve (or other joining device) into which the ends of two floats can be inserted to form one long float. By using two of these joiners, one can form a circular float over which two mesh chairs can be suspended to form a large floating chair for use by two people or to form a floating bed for use by one person.

For a better understanding of the present invention, reference should be made to the drawings and the description in which there are illustrated and described preferred embodiments of the present invention.

DESCRIPTION OF THE DRAWINGS

FIG. 1 is a perspective view of the present invention showing the orientation of its major components with respect to one another.

FIG. 2 is a side elevation view of the present invention showing the orientation of its major components with respect to one another.

FIG. 3 is a top elevation view of the present invention showing the orientation of its major components with respect to one another.

FIG. 4 is a front elevation view of the present invention showing the orientation of its major components with respect to one another.

FIG. 5 is a side elevation view of the present invention showing the manner in which it is employed by a swimmer to float on the surface of the water.

FIG. 6 is a front elevation view of an alternative embodiment of the present invention in which an elastic cord is used to secure the noodle within the mesh seat of the invention.

FIG. 7 is a front elevation view of an alternative embodiment of the present invention showing how the elastic cord engages the noodle when downward pressure is placed on the center of the cord.

FIG. 8 is a perspective view of another alternative embodiment of the present invention in which the noodle securement tube is fashioned in a way which allows noodles of varying sizes to be used with the invention.

FIG. 9 is a perspective view of an alternative embodiment of the present invention showing the adjustable securement tube as used with a noodle with a larger outside diameter than the standard noodle.

FIG. 10 is a perspective view of an alternative embodiment of the present invention showing how the noodle fits within the adjustable noodle tube.

FIG. 11 is a perspective view of a still further embodiment of the present invention in which the fasteners of the adjustable securement tube are male and female snaps as opposed to the Velcro used on the previous embodiment.

FIG. 16 is a top elevation view of the mesh seat component of the present invention showing it as it would appear laid out flat without insertion of the floats.

FIG. 17 is a top elevation view of an alternative embodiment of the mesh seat component of the present invention in which the sides are diagonally tapered at one end of the seat in relation to the other.

FIG. 18 is a top elevation of an alternative embodiment of the mesh seat component of the present invention in which the sides are convexly tapered to one end of the seat in relation to the other.

DESCRIPTION OF THE PREFERRED EMBODIMENT

Figure 12:
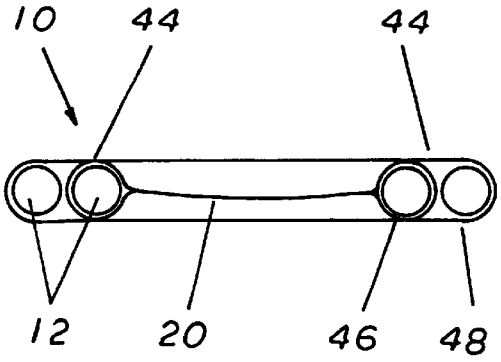
FIG. 12 is a front elevation view of a still further embodiment of the present invention in which the noodle securement tube is fashioned in a way which will allow for the use of two side by side noodles, a single noodle or varying sizes of noodles with the invention.

Referring now to the drawings, and more specifically to FIGS. 1, 2, 3, 4 and 5, the floating chair 10 is made up of a mesh seat 14 which is formed in a U-shaped configuration. The portion of the outer edge of the mesh seat 14 that forms the sides and the closed portion of the U are equipped with a sewn loop that form the float securement tube 16. The float securement tube 16 forms the attachment point for the float 12 which is threaded through the securement tube 16 along the length of the U portion of the mesh seat 14. To make use of the present invention once the float 12 is properly installed within the float securement tube 16, the swimmer 22 places it on the surface of the water 24 and climbs in. Most commonly the swimmer 22 will place his back against the closed end of the U and his feet will extend out of the open end. This allows the swimmer 22 to relax in the water in an orientation in which the majority of his body is below the water's surface 24 and his head and arms are above the water 24.

Additionally, the mesh seat 14 is equipped with a neck opening 18 at the furthest point of the closed end of the U which allows it to drop freely downward to form a seat. This design allows the swimmer 22 to sit comfortably in the depression of the mesh seat 14. The edges of the neck opening 18 (along with the end of the mesh seat 14 that spans the opening of the U) are equipped with a fabric binding 20 that ensures that the exposed ends of the mesh seat 14 will not tear and the swimmer 22 will be secure in his position.

An alternative method of securing the float 12 to the mesh seat 14 is illustrated in FIGS. 6 and 7. In this embodiment of the present invention, the float securement tube 16 is sewn in a fashion so that its inside diameter is larger than that of the previously described manner. This allows for the easier installation and removal of the float 12 from the float securement tube 16. The securement of the float 12 to the mesh seat 14 is accomplished by the use of a elastic cinch cord 26 which surrounds each end of the float securement tube 16 and spans the area between them across the span of the open end of the U. In this configuration, as downward pressure is applied to the mesh seat 14 by the swimmer 22, the elastic cinch cord 26 is also forced downward. This serves to pull on the portions of the cinch cord 26 that surround the float securement tube 16 which tightens that portion around the float 12. This tightening grips the float 12 and ensures that it will not move within the float securement tube 16 and, thus, that the present invention will remain afloat as intended.

A third method of securing the float 12 to the mesh seat 14 is illustrated in FIGS. 8, 9, 10 and 11. In this embodiment of the present invention an adjustable float securement tube 28 is employed to attach the float 12 to the mesh seat 14. The adjustable float securement tube 28 is constructed in a manner that allows it to be opened and closed to allow for the installation and removal of the float 12. This design also allows for the use of floats 12 varying outside diameters with the present invention.

The adjustment feature of this design is accomplished by providing a securement tube that is initially larger in its inside diameter than a standard one. The first portion of the flap that is sewn over to form the tube also forms the adjustment flap 34. The inside of the most forward edge of this adjustment flap 34 (in relation to the sewn edge) is fitted with a Velcro hook strip 36 having the hook portion extending down. Conversely, the back side of the loop formed by the adjustable float securement tube 28 is fitted with a velcro loop strap 38 in a position so that when the two portions of the loop are closed they will engage one another and hold the adjustable float securement tube 28 together. Additionally, FIG. 11 illustrates the use of male snaps 40 and female snaps 42 in the place of the Velcro used to hold the two portions of the adjustable float securement tube 28 together.

The primary benefits that this embodiment provides are that it allows for the easier installation and removal of the float 12 to and from the mesh seat 14 and allows for the use of both standard sized floats 30 and larger floats 32 with the present invention without having to make changes to the mesh seat 14 itself. When a standard sized float 30 is used (as detailed in FIG. 8), the Velcro hook and loop straps, 36 and 38, are joined together to securely hold the float 30 within the adjustable float securement tube 28. Conversely, when a larger float 32 is used (as detailed in FIG. 9), the Velcro hook and loop straps, 36 and 38, remain unattached which allows for the accommodation of the larger float 32 within the adjustable float securement tube 28.

Figure 13:
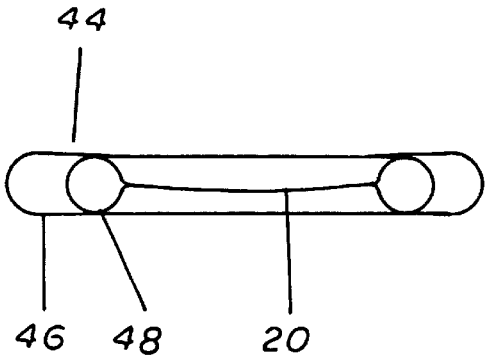
FIG. 13 is a front elevation view of the double noodle or varying size noodle embodiment of the present invention showing the construction method of the double loop securement tube.

A still further method of float 12 attachment to the mesh seat 14 of the present invention is illustrated in FIGS. 12 and 13. In this embodiment, the float 12 is secured by the use of a double loop securement tube 44 which is constructed in a manner in which there is an inner tube 46 and an outer tube 48. The outer tube 48 simply extends outward from the outer most edge of the inner tube 46 and both of them can be constructed in any one of the methods previously described. This design allows for the use of two floats 12 with a single mesh seat 14 which provides a greater degree of buoyancy to the present invention. Further, a single larger float or smaller float by used as desired. This will allow a swimmer 22 to ride higher in the water if he so desires or for a swimmer of greater weight to float in the water in the regular fashion.

Figure 19:
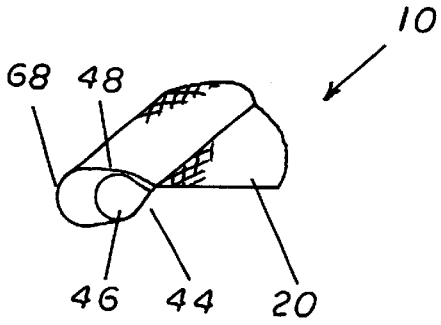
FIG. 19 is a perspective view of the embodiment of the present invention illustrated in FIGS. 12 and 13 further detailing the method of construction of the double loop securement tube.
Figure 20:
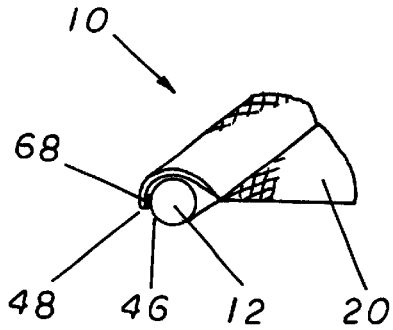
FIG. 20 is a perspective view of the embodiment of the present invention illustrated in FIGS. 12 and 13 detailing the manner in which the outer sleeve may be attached securely out of the way when only the inner sleeve is being used to secure a single float.
Figure 21:
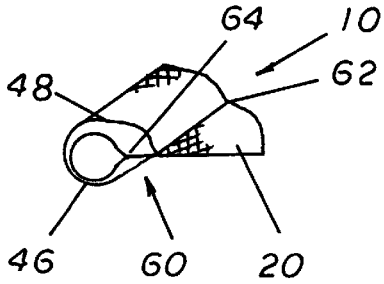
FIG. 21 is a perspective view of a still further double sleeve securement tube embodiment of the present invention in which the inner sleeve is positioned in the outer portion of the outer sleeve.
Figure 22:
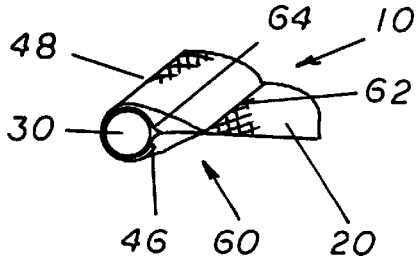
FIG. 22 is a perspective view of a the second embodiment of the double sleeve securement tube of the present invention illustrating its use with a single small float installed in the inner tube.
Figure 23:
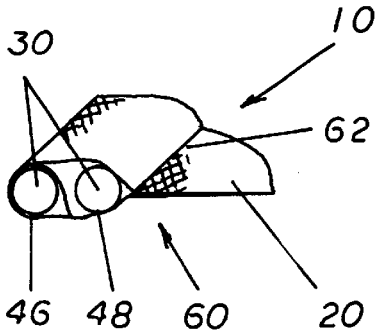
FIG. 23 is a perspective view of a the second embodiment of the double sleeve securement tube of the present invention its use with two small floats installed in both the inner and outer sleeves.
Figure 24:
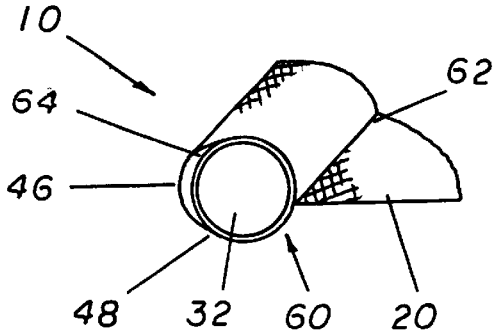
FIG. 24 is a perspective view of a second embodiment of the double sleeve securement tube of the present invention illustrating its use with a single large float installed in its outer tube.

Additionally, the outer loop 48 of the double loop securement tube 44 can also be equipped with an outer loop attachment 68 which is illustrated in FIGS. 19 and 20. The outer loop attachment 68 is a securement device that is located on the outer loop 48 and used to secure the outer loop 48 to the inner loop 46 when only the inner loop 46 is used to secure a float 12. This is accomplished by folding the unused outer loop 48 back in upon itself and attaching the exposed attachment 68 to the inner loop 46 which severs to hold the folded outer loop 48 securely. This ensures that the unused material of the outer loop 48 of the double loop securement tube 44 will not interfere with the enjoyment of the present invention.

Figure 14:
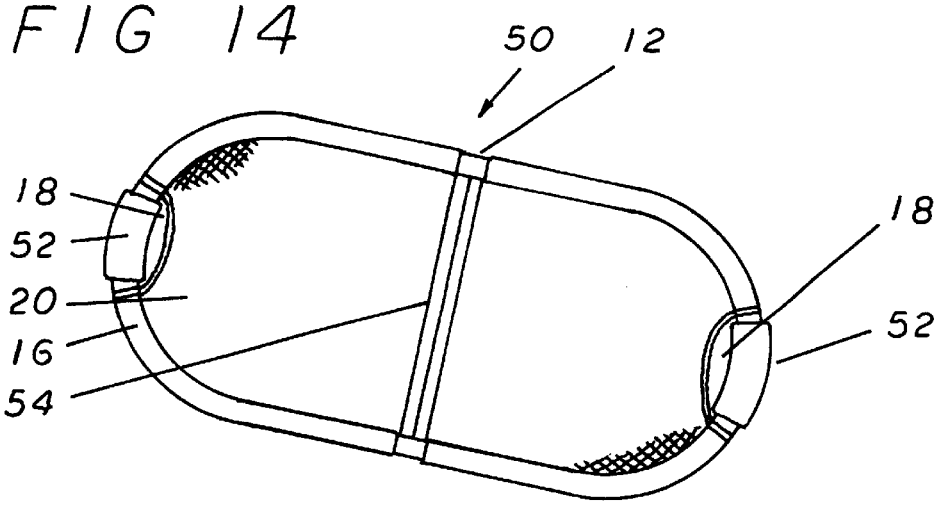
FIG. 14 is a top elevation view of the final embodiment of the present invention in which two noodle chairs can be joined together to form a large single floating chair.
Figure 15:
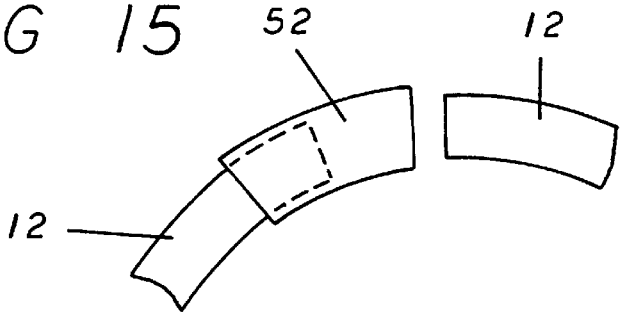
FIG. 15 is a top elevation cut-away view of the noodle joining component of this embodiment of the present invention showing the manner in which the two noodles can be joined to form the large.

The present invention can also be used in conjunction with another to form a larger floating platform, or double chair 50, as illustrated in FIGS. 14 and 15. In this configuration, two mesh seats 14 are placed together with the open end of each of their U's butting against one another. One float 12 is then run through one side of the float securement tubes 16 of both mesh seats 14 from the neck opening 18 of one to the neck opening 18 of the other. This process is then repeated along the securement tube 16 on the other side so that the ends of both floats 12 used are protruding within the neck openings 18 on either end of the joined mesh seats 14. The loose ends of the floats 12 are then joined together by the use of the attachment sleeve 52 which is a hollow section of floating material (or other attachment method such as a sewn pocket of mesh material, etc.) whose inside diameter is equal to the outside diameter of the floats 12. This provides a snug fit which serves to hold the ends of the two floats 12 together. Additionally, the edge of the mesh seat 14 that spans the open end of the U is equipped with a mesh seat attachment strip 54 (typically made of Velcro or other fastening material) which serves to connect the two mesh seats 14 together to further secure the attachment of the two floating chairs 10 to form the double chair 50.

Another alternative means of securing a float 12 or plurality of floats 12 to the mesh seat 14 of the present invention is illustrated in FIGS. 21, 22, 23 and 24. In this embodiment of the present invention the float 12 is attached by the use of the two stitch double loop securement tube 60. With this method of float 12 securement, as opposed to methods previously described, the inner loop 46 closed off with a separate inner stitch 62 and is positioned at the outer edge of the outer loop 48 which is in turn separately closed off by the outer stitch 64. This design allows for the use of a single standard float 30 to be installed in the inner loop 46 (illustrated in FIG. 22) while avoiding the problem of loose unused material because the unused outer loop is pulled tight by placing weight on the mesh seat 14.

Alternatively, the two stitch double loop securement tube 60 can also be used with two standard floats 30 (illustrated in FIG. 23) one installed in each of the inner and outer tubes, 46 and 48. Finally, the two stitch securement tube 60 can also be used with a larger float 32 (illustrated in FIG. 24) which is inserted into the outer loop 48 which effectively folds up the inner loop 46 and therefore also avoids the problem of loose, unused material interfering with the use of the present invention. The use of the two stitch double securement tube 60 allows the user to adjust the amount of floatation provided by the invention.

Various alternative means of constructing the mesh seat 14 component of the present invention are illustrated in FIGS. 16, 17 and 18. FIG. 16 illustrations the construction method of a standard mesh seat 14 in which the sides containing the float securement tubes 16 are parallel to one another, thus forming a rectangular mesh seat 14. FIG. 17 illustrates a diagonally tapered mesh seat 56 in which the sides containing the float securement tubes 16 taper diagonally from one end to another, thus forming a triangle with a flattened top. FIG. 18 illustrates a convexly tapered mesh seat 58 in which the side containing the float securement tubes 16 are convexly curved, in relation to the center line of the seat, to form a seat with one end being substantially wider at one end than the other. The purpose of these tapered seats is to narrow the area in which the swimmer 22 sits during the use of the present invention. This has the effect of raising the swimmer's 22 body in relation to the water line 24 and therefore allows the swimmer 22 to expose more of his body to the air and sun.

Although the present invention has been described in considerable detail with reference to certain preferred versions thereof, other versions are possible. Therefore, the spirit and scope of the protection should not be limited to the description of the preferred versions or claimed versions contained herein.

What is claimed:

1. A floating water chair comprising:

a substantially rectangular mesh seat section having a first side and second side, a front side and a back side, said mesh seat section being of a size to allow a users leas to hang over said front side, said back side forms a chair section so as to hold a user's body in a generally seated upright position;

a float securement section forming a tubular loop section on said first and second side;

an elongate cylindrical foam tube having a length greater than said first and second side of said rectangular mesh seat; and a means of securing said cylindrical foam tube in said tubular loop section.

2. A floating water chair as in claim 1 wherein said means of securing said cylindrical foam tube into said tubular loop section is an elongate elastic cord section along the front of said mesh seat section and about said tubular loop section such that weight on said mesh seat section pulls said cord section tight about said foam tube.

3. A floating water chair as in claim 1 wherein said means of securing said cylindrical foam tube into said tubular loop section is a hook and loop fastener section.

4. A floating water chair comprising:

a substantially rectangular mesh seat section having a first side and second side, a front side and a back side;

a first float securement section forming a first tubular loop section on said first and second side;

a second float securement section about said first float securement section forming a second tubular loop section outside of said first tubular loop section on said first and second side;

and at least one elongate cylindrical foam tube having a length greater than said first and second side of said rectangular mesh seat; and a means of securing said cylindrical foam tube in one of said tubular loop sections.

5. A floating water chair as in claim 4 wherein said means of securing said cylindrical foam tube into one of said tubular loop sections is an elongate elastic cord section along the front of said mesh seat section and about said tubular loop section such that weight on said mesh seat section pulls said cord section tight about said foam tube.

6. A floating water chair as in claim 5 further comprising a second elongate cylindrical foam tube having a length greater then said first and said second side of said rectangular mesh seat section.

7. A floating water chair comprising:

a substantially rectangular mesh seat section having a first side and second side, a front side and a back side;

a first float securement section forming a first tubular loop section on said first and second side;

a second float securement section forming a second tubular loop section on said first and second side;

and at least one elongate cylindrical foam tube having a length greater than said first and second side of said rectangular mesh seat.

8. A floating water chair as in claim 7 further comprising a means of securing said cylindrical foam tube in one of said tubular loop sections.

9. A floating water chair as in claim 8 wherein said means of securing said cylindrical foam tube into one of said tubular loop sections is an elongate elastic cord section along the front of said mesh seat section and about said tubular loop section such that weight on said mesh seat section pulls said cord section tight about said foam tube.

10. A floating water chair as in claim 8 wherein said means of securing said cylindrical foam tube into one of said tubular loop section is a sewn outer edge on said seat section so as to frictionally hold said cylindrical foam tube.

11. A floating water chair as in claim 7 further comprising a second elongate cylindrical foam tube having a length greater then said first and said second side of said rectangular mesh seat section.

* * * * *